US005518183A

United States Patent [19]

Waldrum

[11] Patent Number: 5,518,183

[45] Date of Patent: May 21, 1996

[54] MICRO-ORIFICE NOZZLE

[75] Inventor: John E. Waldrum, Ambler, Pa.

[73] Assignee: Waldrum Specialties, Inc., Doylestown, Pa.

[21] Appl. No.: 331,084

[22] Filed: Oct. 28, 1994

[51] Int. Cl.[6] ..... B05B 1/08

[52] U.S. Cl. ..... 239/460

[58] Field of Search ..... 239/451, 460, 239/558, 107

[56] References Cited

U.S. PATENT DOCUMENTS

| | | | |
|---|---|---|---|
| 910,400 | 1/1909 | Lischer . | |
| 1,934,553 | 11/1933 | Mueller et al. | 239/558 X |
| 1,947,407 | 2/1934 | Cornell | 239/451 |
| 2,162,057 | 6/1939 | Brandt et al. | 299/97 |
| 2,267,992 | 12/1941 | Palmer | 239/107 |
| 2,749,183 | 6/1956 | Fraser | 239/451 |
| 2,928,607 | 3/1960 | Shames et al. | 239/107 |
| 3,197,299 | 5/1961 | Stull et al. | 71/2.1 |
| 3,416,734 | 12/1968 | Nelson | 239/460 |
| 3,445,065 | 5/1969 | Waldrun | 239/159 |
| 3,499,606 | 3/1970 | Smith | 239/304 |
| 3,592,385 | 7/1971 | Smith | 239/10 |
| 3,640,461 | 2/1972 | Koll | 239/7 |
| 3,684,177 | 8/1972 | Barlow | 239/171 |
| 3,887,129 | 6/1975 | Brown | 239/119 |
| 4,346,844 | 8/1982 | Harmony | 239/460 X |
| 4,790,483 | 12/1988 | Gill | 239/224 |
| 4,801,088 | 1/1989 | Baker | 239/152 |
| 4,824,024 | 4/1989 | Bishop et al. | 239/333.15 |
| 5,020,725 | 6/1991 | Waldrum | 239/154 |
| 5,025,988 | 6/1991 | Lund | 239/171 |
| 5,033,676 | 7/1991 | King et al. | 239/107 |
| 5,110,048 | 5/1992 | Waldrum | 239/171 |
| 5,248,086 | 9/1993 | Waldrum et al. | 239/10 |
| 5,543,804 | 3/1994 | Salemone | 239/460 |

FOREIGN PATENT DOCUMENTS 2094668 9/1982 United Kingdom .

OTHER PUBLICATIONS

Waldrum Specialties, Inc., The Radiarc Skid Mount System. TVB Thru Valve Boom System.

Waldrum Specialties, Inc., Thinvert Application System for Aircraft, Sep. 1993.

Waldrum Specialties, Inc., Thinvert Backpack System, Nov. 1993.

Waldrum Specialties, Inc., The Radiarc Sprayer.

*Primary Examiner*—Kevin P. Weldon

*Attorney, Agent, or Firm*—Eckert Seamans Cherin & Mellott

[57] ABSTRACT

A dispensing nozzle is provided with uniform, very-small diameter orifices of 0.001 to 0.015 inch (25 to 400 microns) by slotting at least one of two preferably-conical abutting faces between relatively movable parts defining a nozzle wall. The orifices can be formed by cutting with a broach to form an array of slots in a conical plug structure that fits against a complementary conical seat. Micro-orifices are defined between the conical structure and seat, preferably with an internal diameter of about 0.004 to 0.007 inch (100 to 170 microns) for dispensing uniform small droplets of thin oil/water invert emulsions. The conical structure can be liftable from the seat for flushing the slots by use of a spring mount, whereby increasing the dispensing pressure lifts the plug and flushes the slots. A filter screen reduces the tendency of the nozzle to clog. The dispensing nozzle provides an efficient and cost effective means to form uniform small droplets, enabling ultra low volume spraying of agricultural active agents in thin invert emulsions, for example obtaining effective applications at one pint to one quart per acre.

15 Claims, 4 Drawing Sheets

MICRO-ORIFICE NOZZLE

BACKGROUND OF THE INVENTION

1. Field of the Invention

The invention relates to delivery systems for chemical agents such as herbicides, pesticides, fungicides, growth regulators and the like, and in particular to a nozzle arrangement for delivering a controlled spray of thin oil/water emulsion in the form of very-small droplets of uniform size. The invention is especially suitable for delivering thin oil/water inverts that form by surface tension and visco-elastic effects into droplets having an oil phase enclosing a water phase droplet.

2. Prior Art

In applying herbicides, pesticides, fungicides, plant growth regulators and similar agents to an area to be treated, it is highly desirable for a number of reasons to apply only the minimum amount of the agent necessary to achieve the desired effect, and to apply the agent accurately, i.e., only to the area being treated. Insofar as the agent is applied in an unnecessarily high concentration, or in a form that is not readily absorbed, or drifts away from the target site in the air, or evaporates before it is absorbed, the agent is not only wasted, but is a form of pollution.

Oil soluble and water soluble carriers for active agents are known. For the most part, the active ingredients used in the oil soluble and water soluble formulations are the same. Esters are examples of oil soluble carriers and amines are examples of water soluble ones. Esters are volatile. Even after reaching the vegetation or the like to be treated, the ester can volatilize before the active ingredient is absorbed. Similarly, amines are subject to evaporation. As an amine is delivered, a proportion of the water evaporates and is lost into the air. Both water soluble and oil soluble products should be delivered in a form that will minimize the loss of active material and the escape of active material into the environment, before absorption.

Both the form of the liquid being applied and the mechanics of application of the liquid are important considerations in connection with agricultural spraying and the like, for achieving the effects desired. In so-called "invert" formulations, an emulsion of water and oil is provided. Apart from the active ingredient(s), an emulsion comprises oil, water and an emulsifier or surfactant. The emulsifier is partly soluble in the oil phase and partly in the water phase, according to a hydrophile/lipophile balance factor that varies with temperature. By agitating a mixture of oil, water and emulsifier/surfactant, the immiscible oil and water are dispersed in the composition, with the emulsifier occupying surface boundaries between the oil and the water. Over time, the oil and water parts of an emulsion tend to separate, and may require agitation to reconstitute the emulsion.

Agitation affects the viscosity of the emulsion. Invert emulsions for application of agricultural agents are typically made viscous as a means to control droplet size. The viscosity is controllable by choice of the viscosity of the oil and/or by agitation to thicken the liquid. A more viscous (thicker) liquid formulation forms larger droplets when sprayed, than a less viscous liquid. Large droplets are more affected by gravity than by cross currents in the air, and are apt to fall directly onto the site rather than to drift in the wind.

U.S. Pat. No. 3,197,299—Stull discloses an example of a method and apparatus for spraying an invert emulsion. The invert is made as thick as mayonnaise, in an effort to form very large droplets or globs of material when sprayed via a nozzle device that impels a stream of oil and a stream of water together at an outlet to obtain agitation. The present invention takes a different approach to the problem of applying the active agent. Given that the same amount of material is dispensed, smaller droplets have been found to achieve more uniform coverage of foliage and the like than do larger droplets, provided the droplets can be kept small and uniform. Accordingly, the emulsion is made very thin, and is applied using a nozzle arrangement that forms droplets of uniform small diameter.

In a cross wind, large droplets of a thick invert fall more directly than small droplets. However, in practice, large droplets cannot be formed to uniform size, and as the droplets are formed and emitted from the sprayer, they separate into an aggregation of larger and smaller droplets. The smaller droplets of an aggregation of large and small droplets are subject to evaporation and drift, leading to widening of the swath of application from the sprayer. A spray of uniform small droplets is subject to displacement in a cross wind, but the displacement of the droplets is uniform because the droplets are uniform.

With a given quantity of agricultural chemical, smaller droplet application is more even on the smaller scale of the plant foliage. Unless the material is applied so heavily as to completely wet the leaves, large droplets spot the leaves with local concentrations of the active ingredient and relatively large spaces between them. Smaller droplets result in a larger number of smaller droplets, separated by smaller spaces. Thus the application is more even, and more effective.

Several parameters affect droplet size, including the viscosity of the liquid, the size and flow characteristics through the dispensing orifice and the like. When an emulsion of oil and water is emitted through a dispensing orifice, typically as a stream, surface tension progressively divides the stream along its length, as the stream flows from the point of emission. The oil in an invert emulsion forms a film on the water in a droplet and tends to hold the water in place. By balancing the viscosity of the liquid and the size of the stream emitted through the dispensing orifice, a balance can be struck. Dispensing orifices can be reduced in size to form smaller droplets. However, relatively smaller orifices increase the back pressure, and it is difficult or impossible to force viscous liquids through very small passages.

The effect of surface tension on an emitted stream of liquid is a much studied phenomenon. The inertia of liquid flowing through an orifice in a stream at first carries the liquid from the orifice in a solid stream having a uniform cross sectional diameter substantially equal to the internal diameter of the orifice. This lasts only for a short distance from the orifice. Surface tension acting on the stream causes the liquid to accumulate in droplets which are spaced by a distance related to the viscosity and surface tension of the liquid. Between adjacent forming droplets, a web of liquid is stretched and finally broken as the liquid is drawn into one of the two adjacent droplets. The emitted stream thus changes from a cylinder of liquid to a succession of droplets, with most of the liquid being drawn into a droplet adjacent its location. Near the midpoint between adjacent droplets a smaller droplet known as a satellite is often formed from a portion of the liquid which occupied the web that was stretched and broken as the stream formed into droplets. The satellite is about a tenth the size of the adjacent droplets.

In a thick invert formulation, the viscosity of the liquid makes it difficult or impossible to discharge the liquid through small orifices, to form small droplets. The thick invert liquid therefore is discharged through relatively larger orifices. When a stream of the liquid is emitted, droplets form in a wide range of sizes, both small and large. Whereas the basic objective of using a thick invert is to achieve large droplet sizes for better drift control, this objective is only partly met.

Provided the liquid can be forced through the dispensing orifices, it is generally possible to achieve a small droplet size by using small diameter orifices. According to the present invention, droplets are formed using a thin invert emulsion emitted through capillary sized passages, i.e., having a diameter which is small enough that surface tension causes the liquid to fill the internal diameter of the passages. Drift is controlled by the mechanics of application of the product, such as dispensing in the immediate area of the target, rather than by relying on large droplet size. The better coverage of uniform small droplets provides high efficacy and substantially reduces the volume of the agent needed to achieve the desired effect, per unit of coverage area.

Down to a certain diameter, a small conduit can be arranged by drilling a bore in a nozzle wall or by placing a tube through a nozzle wall, for example as in U.S. Pat. No. 5,110,048—Waldrum. At some point, however, reducing the conduit size causes manufacturing problems as well as problems in use. It is impractical, for example, to attempt to form an orifice having an internal diameter less than about 0.015 inch. Such a hole is too small to drill dependably to a uniform size. Even when formed, the orifice is likely to become plugged by solid material in the liquid to be dispensed. Once plugged, the orifice is almost impossible to clean.

The present invention is intended to provide a very small orifice, preferably on the order of 0.002 to 0.015 inch or smaller. The orifice preferably is used to form droplets of about 250 to 300 microns diameter, and is especially useful for application of thin invert emulsions. Moreover, according to one aspect of the invention, the orifices can be readily cleaned.

Assuming that a uniform application of small droplets can be accomplished, the amount of active material applied to a site, as well as the volume of carrier liquid can be reduced. With uniform and accurate coverage, a more concentrated agent can be applied. Smaller, lighter equipment can be used to apply the material. The thin invert formulation, characterized by an oil phase on a water phase, reduces problems with evaporation. The oil also assists in penetration of the waxy surface of vegetation. In short, the overall effectiveness of application is improved.

According to the invention, a dispensing nozzle is provided with uniform, very-small diameter orifices by slotting at least one of two abutting faces between relatively movable parts defining a nozzle wall. The orifices can be formed by cutting with a broach to form an array of slots in a conical structure adapted to fit a complementary conical seat. Micro-orifices are defined between the conical structure and seat. For cleaning, the conical structure can be lifted from the seat, thus flushing the slots. A filtration arrangement including a screen reduces the tendency of the nozzle to clog. The dispensing nozzle provides an efficient and cost effective solution to the problem of forming uniform small droplets, for use with thin invert emulsions.

SUMMARY OF THE INVENTION

It is an object of the invention to provide a nozzle for applying thin invert preparations in the form of uniform small droplets, with a minimum of loss of material due to drift.

It is also an object of the invention to provide a nozzle which is easy to manufacture.

It is a further an object of the invention to provide a nozzle which is easy to clean in the event a clog develops.

These and other objects are accomplished by a micro-orifice nozzle for delivering a liquid chemical agent especially adapted for oil/water inverts. The nozzle having two conical surfaces mated together, at least one conical surface being grooved such that a plurality of capillary sized orifices are formed. The nozzle also incorporating a filter for removing particles from the chemical agent which could lodge in a capillary sized orifice thereby clogging the nozzle.

Other objects and advantages of the invention will become apparent from the following description and the accompanying drawings, which are directed to exemplary embodiments.

BRIEF DESCRIPTION OF THE DRAWINGS

The drawings show embodiments of the invention that are presently preferred. It should be understood that the invention is not limited to the arrangements and instrumentalities shown in the drawings and is capable of embodiments in other groupings of parts, subassemblies and the like, in accordance with the scope of the invention claimed.

DETAILED DESCRIPTION OF THE INVENTION

The present invention relates to a nozzle for delivery of a thin invert chemical composition, for example to apply agricultural chemical to a target area. As used herein, the term "thin invert" refers to water and oil compositions which are agitated, at least initially, to obtain an emulsion. The nozzle of the invention is arranged for application of a thin invert chemical composition, by pumping the composition through a plurality of small orifices, e.g., of about 0.001 to 0.002 inches internal diameter. The water and oil phases become "inverted" in that the oil phase surrounds the water phase as the streams of emitted liquid subdivide into droplets by surface tension. Whereas the orifices are small and the chemical composition thin in viscosity, the composition forms uniform droplets of about 250 to 300 microns maximum mean diameter, having an oil phase surrounding a water phase.

Figure 1:
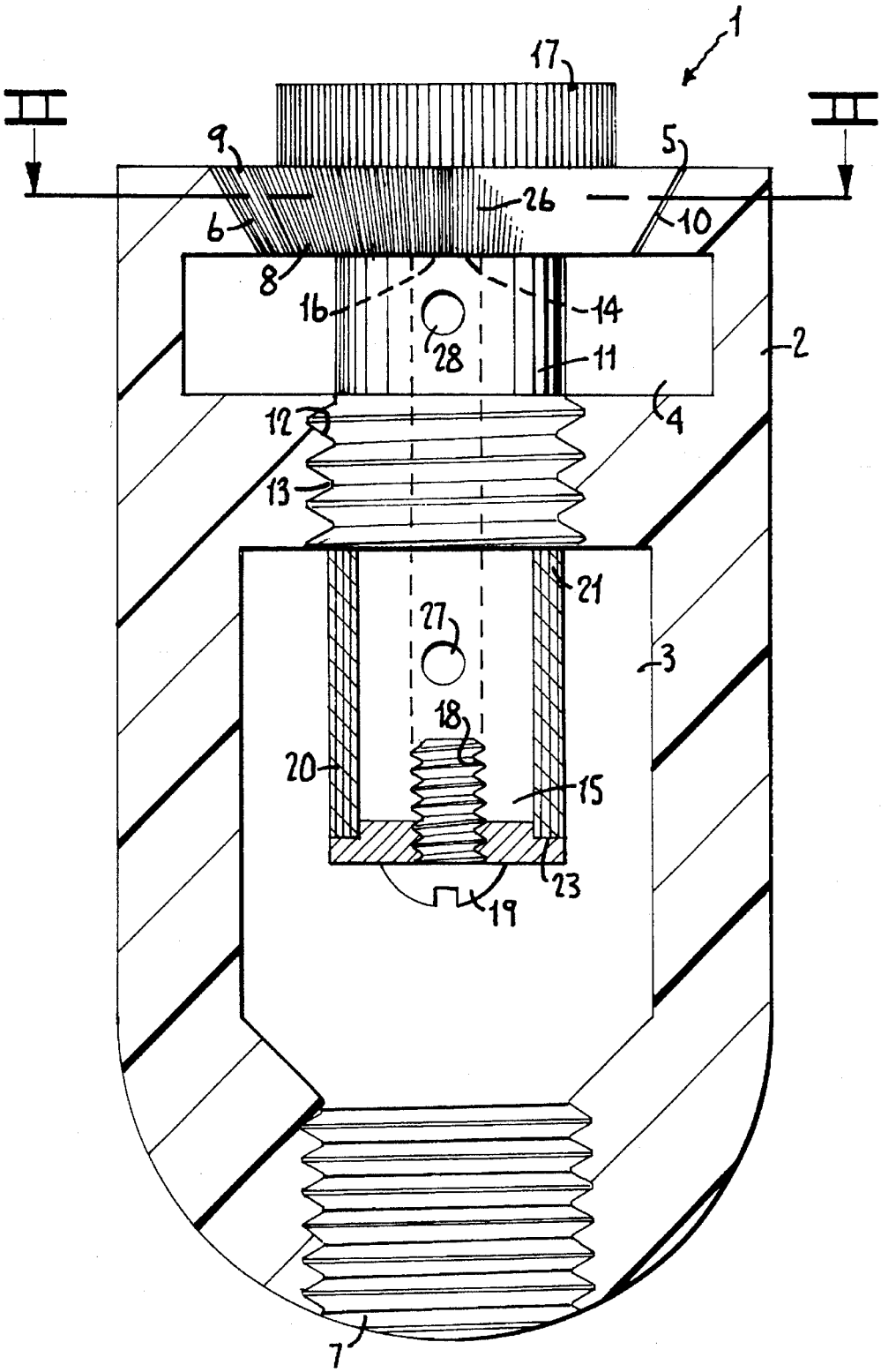
FIG. 1 is a sectional view of a micro-orifice nozzle in an embodiment showing the plug rigidly threaded into the casing.

Referring to FIG. 1 the nozzle 1 has a casing 2 with a two internal reservoirs 3 and 4. The casing has two open ends, a first end 5 with a conical mating seat 6 and a second end 7. The nozzle can be attached via the threads at end 7 to a spraying boom, a spraying wand or to any similar conduit structure (not shown) for delivering the active treatment liquid to reservoir 3, under pressure.

The nozzle as shown in FIG. 1 provides for rigid mounting of a plug 8 inside the casing 2. Plug 8 has a first end 9 with a conical face 10 which is accurately machined to fit closely in the mating seat 6, the conical face being connected to a hollow tube 11. The hollow tube is fitted with a first set of threads 12 which engage a second set of threads in the casing 13, thereby rigidly retaining the plug in the casing. According to this embodiment, the plug can be threadably loosened, for example to flush the mating conical faces of the nozzle. It is also possible to mount the plug by resilient means causing the conical faces to bear against one another as discussed more fully hereinafter. In that case, the nozzle can be flushed by increasing the dispensing pressure sufficiently to overcome the resilient means and raise the conical faces from one another.

Plug 8 has a longitudinal bore with a closed defined by the bottom of plug 9. The plug has a protruding knurled surface 17 for manual manipulation or for receiving a tool such that the plug may be screwed tightly into the casing and so the angular position of the plug with respect to the casing may be adjusted.

The hollow tube 11 has two ends, a closed end 14, where the hollow tube is connected to the plug, and an open end 15. The open end of the hollow tube has an internal thread 18 in order to receive a screw 19. A filter screen 20 is positioned over the open end of the hollow tube 15 and permits fluid to pass from reservoir 3 into hollow tube 11 such that the fluid can pass the area of threads 12, 13 to reservoir 2. Screen 20 bears longitudinally against a shoulder adjacent threads 12 at end 21 and can be fitted with a gasket (not shown). An end cap 23 is fitted into the second end of screen 20, and has a central opening 25 for receiving screw 19 such that the screen and plug form an assembled unit. The screw 19 is passed through the central opening in the end cap 25 and is threaded into the open end of the hollow tube 15, thereby retaining the filter screen 21. Preferably, the screen is disposed at end 21 and at cap 23 to provide as tight a seal at the open ends of the filter screen 21 as the level of filtration provided by the filter screen, so that impurities that would normally be filtered cannot flow around the filter screen and clog the nozzle.

Figure 2:
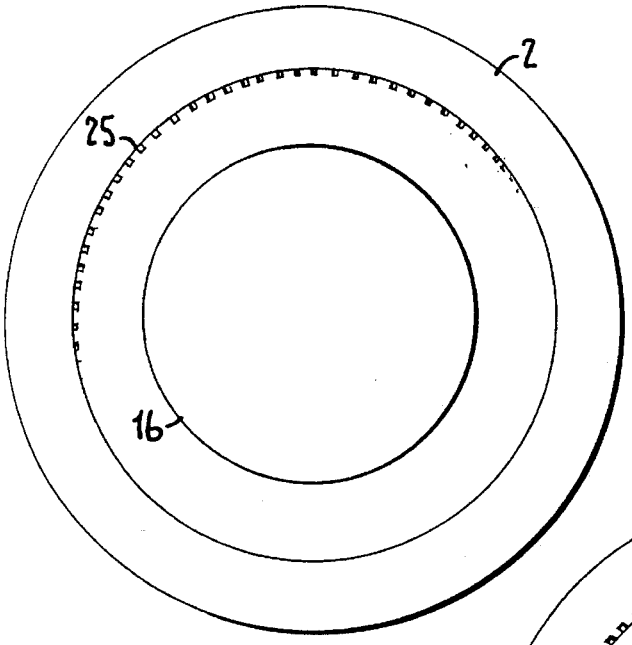
FIG. 2 is a section view taken along lines 2—2 in FIG. 1.
Figure 5:
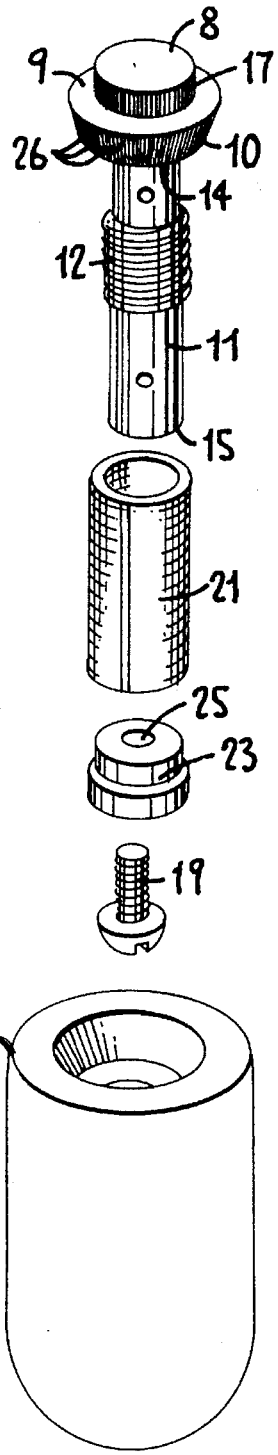
FIG. 5 is an exploded perspective view of the nozzle according to FIG. 1.

FIGS. 1 and 5 show a plurality of grooves 26, that extend over the entire length of the conical face 10. The grooves are of appropriate size such that a plurality of capillary sized orifices are formed when the conical face is coupled with the mating seat as shown in FIG. 2. A thin invert chemical composition is pressure fed into end 7 of the casing, through a suitable threaded conduit. The composition fills the first reservoir 3, and surrounds the filter screen 20. The composition passes through the filter screen and enters the inlet hole 27. The composition fills the hollow tube 11 and passes through the exit hole 28 into the second reservoir 4, and is forced out through the capillary sized orifices between the conical face 10 and the mating seat 6. The spray pattern produced by nozzle 1 is characterized by uniform small droplets.

It can be difficult or impossible, as a practical matter, to drill a hole to a diameter less than about 0.015 inch. Grooves 26 preferably are formed by using a broach. A broach is advantageous to drilling in that a drill bit tends to wander and can make precise machining operations difficult. In order to produce droplets in the 250 to 300 micron range, the nozzle must have orifices in the range of 0.001 to 0.015 inch inside diameter. Preferably, the orifices have an inside diameter or span of about 0.002 inch. The use of grooved conical surfaces mated together allows for accurately formed orifices wile minimizing manufacturing costs. The profile of the grooves is shown as basically semi-circular, however other two dimensional shapes, such as rectangular or triangular slots, also can be used.

Figure 3:
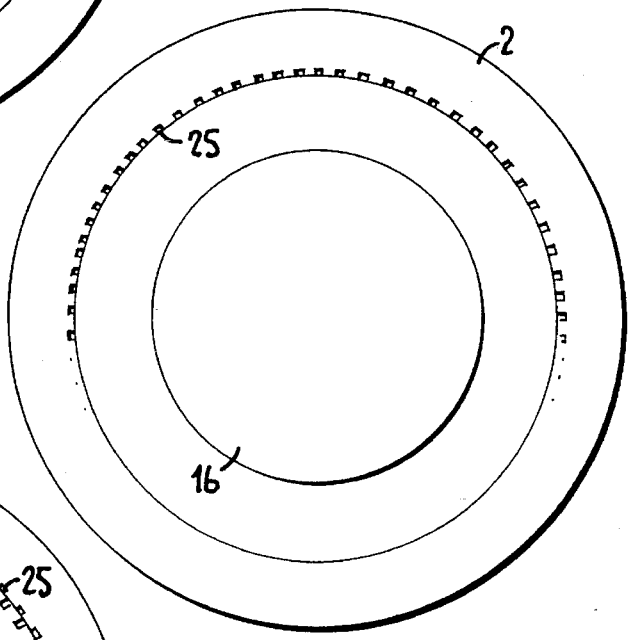
FIG. 3 is a section view corresponding to FIG. 2 and showing an alternative embodiment.
Figure 4:
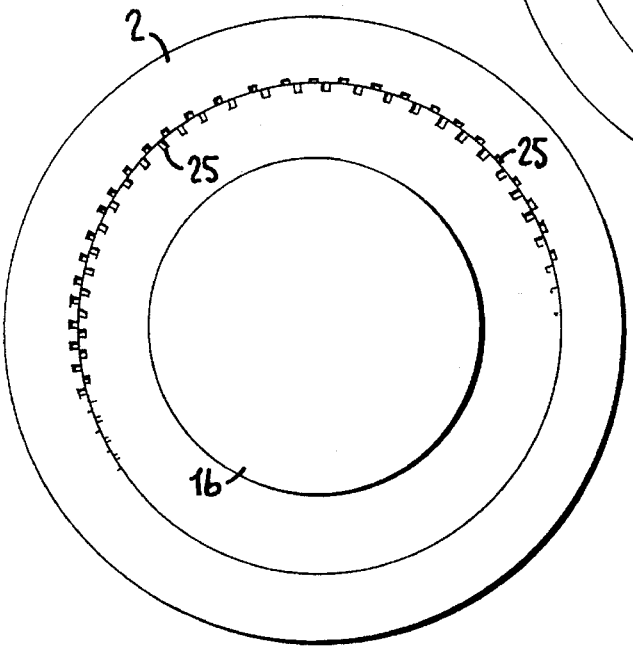
FIG. 4 is a section view of a further alternative embodiment.

FIGS. 1 and 2 show an embodiment where the conical surface of the plug is grooved to form orifices with a smoothly conical seat. FIG. 3 shows an alternative embodiment where the mating seat is grooved and the plug is smooth in order to form the orifices. Depending on the type of machining facilities available it may be easier to groove the outer surface of the plug than to groove the inner surface of the mating seat. FIG. 4 shows an alternative embodiment where both the conical surface of the plug and the mating seat both are grooved. This doubles the number of orifices provided. Moreover, the plug may be rotated with respect to the casing thereby altering the alignment of the grooves on the plug with respect to the grooves on the mating seat. This embodiment thus can be arranged to provide larger or smaller orifices by aligning or misaligning the slots in the inner and outer mating surfaces. A detent arrangement can be provided to set the inner and outer surfaces in alignment.

When a groove on the plug is aligned with a groove on the mating seat the diameter of the orifice is effectively doubled. The droplet produced from the two aligned grooves will be roughly twice the diameter produced from a non-aligned groove. A droplet, which is roughly spherical in shape, has a volume characterized by the formula;

$$\text{Volume}=4/3\ (\pi R^3)$$

where R is the radius. Therefore a factor of two increase in diameter (or radius) translates into a factor of eight increase in volume. Different arrangements of grooves on the plug and the mating seat can effectively adjust the volume of thin invert delivered by a factor of 8.

Figure 6:
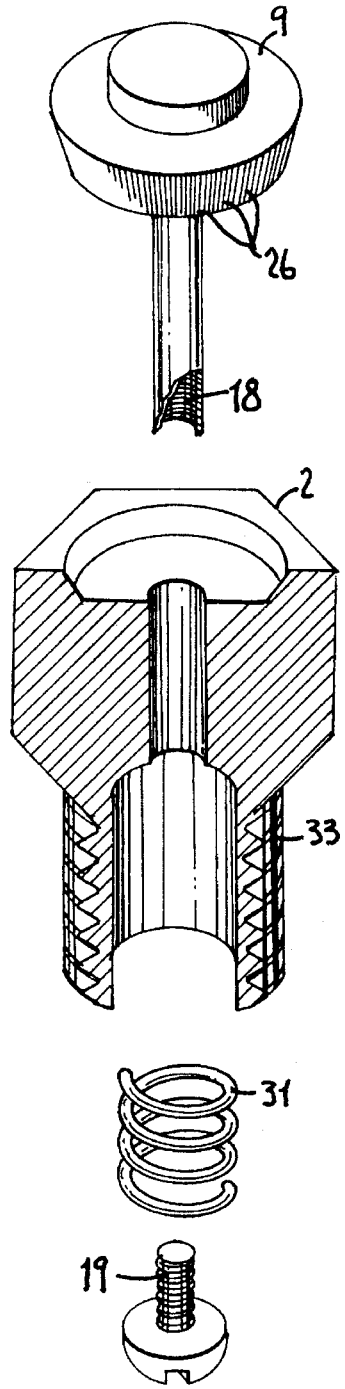
FIG. 6 is an exploded view, partly in section, of an alternative embodiment arranged for flushing.

Prior art designs utilizing a plurality of capillary tubes small with outlet openings are more difficult to manufacture and can become clogged easily. FIG. 6 shows an embodiment of the invention in which the plug is movably retained in the casing, allowing the conical surface and the mating seat to be separated by a small gap. In the event some or all of the plurality of orifices become clogged while dispensing a chemical composition, the conical surface and the mating seat can momentarily separated allowing any obstruction to flow freely from the nozzle. As in the previous embodiments, plug 9 is mounted in casing 2 and mates with a complementary conical opening in the casing but for a number of grooves 26 that form the dispensing apertures. According to this embodiment, plug 9 is resiliently mounted in casing 2 via a compression spring 31 that bears upwardly in the casing and against a screw 19 threadably received in bore 18 in the shaft of plug 9. Under normal dispensing pressure, plug 9 remains against casing 2. When clogged, the dispensing pressure can be momentarily increased to raise plug 9 against the resilient pressure of spring 31, thereby flushing grooves 26 and cleaning out the nozzle. In FIG. 6, casing 2 has external threads 33 rather than internal ones. In addition, plug 9 can have a solid shaft that fits slidably in the casing with clearance for the chemical composition to pass through the central bore in the casing around the shaft of the plug.

Figure 7:
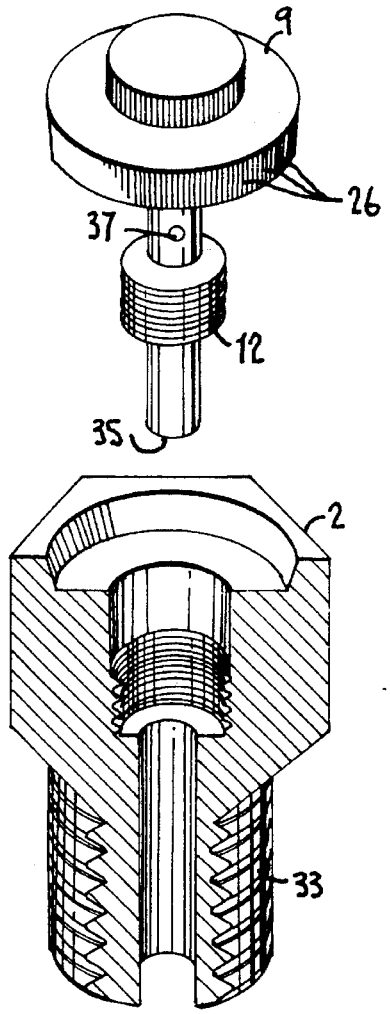
FIG. 7 is an exploded view, partly in section, of a further alternative embodiment.

In the alternative embodiment of FIG. 7, casing 2 is internally threaded for attachment of plug 9 via threads 12. The shaft of plug 9 is hollow, and the chemical composition passes through an internal bore 35 in the shaft to pass through one or more lateral holes 37 into the area of the casing behind grooves 26, through which the composition is dispensed via grooves 26.

The respective embodiments of FIGS. 1–7 are arranged for different particular applications. The embodiment of FIG. 1 is preferred for attachment to a boom of an aerial spray device. The embodiments of FIGS. 6 and 7 are preferred for mounting on a wand of a vehicle mounted or backpack sprayer. The respective embodiments also vary with respect to the conical angle of plug 9, and the number and size of orifices, as well as the angular pattern of orifices around plug 9, which affect the dispersion pattern produced. Preferably, the conical angle ranges from 10° to 30°, for example with a pattern of twenty orifice slots and a 10° conical angle used for over-canopy spraying, a pattern of thirty orifice slots and a 15° conical angle used for general purpose spraying, and a pattern of thirty orifice slots and a 30° conical angle used for broadcast spraying. With aerial spraying, the orifices can be provided around 360° of the plug, for example with 144 equally spaced slots. With backpack sprayers, the user may prefer more or less angular divergence as produced by the conical angle and the pattern of orifices around the plug, and preferred arrangements include a backpack type nozzle with five orifices of 0.015 inch internal diameter located substantially on one side of plug 9 and a 10° conical angle, or a nozzle with 31 orifices of 0.007 inch and a 15° conical angle.

Similarly, the orifice size is subject to some variation but preferably is microorifice size, namely less than 0.015 inches (380 microns) inside diameter. The preferred orifice size is 0.004 to 0.007 inch inside diameter (100 to 170 microns). The nozzle can dispense thin invert emulsions down to 0.001 inch (25 microns), however the dispensing pressure at this minimum orifice size is substantial (e.g., 100 psi). An orifice size of 0.004 inch produces uniform small droplets of about 100 to 150 microns, and an orifice of 0.007 inch produces droplets of about 250 microns. The dispensing pressure needed is about 40 to 50 psi. For operating the self-flushing features according to FIG. 6, a diverter valve or the like can be provided in the device, for momentarily switching from a nominal operating pressure of e.g., 50 psi to a flushing pressure of 70 or 80 psi to lift plug 9. The particular pressure at which the nozzle flushes can be adjusted, for example, by adjusting screw 19 to compress spring 31 more or less.

The nozzle of the invention is particularly useful for spraying thin invert emulsions. The nozzle orifices are approximately as small as the minimum droplet size formed by the liquid composition as a stream breaks up in the air due to surface tension. Thus the droplets formed by the nozzle are small and of uniform size when sprayed. Used with a thin invert, such as disclosed in commonly owned U.S. patent application Ser. No. 07/782,505, filed Oct. 25, 1991 and hereby incorporated, the small orifice nozzle is not subject to undue back pressure. Whereas the slotted mating surfaces can be displaced axially to allow the nozzle to be flushed, the nozzle is not subject to difficult problems with clogging.

The invention having been disclosed in connection with certain preferred embodiments and examples, variations will now be apparent to persons skilled in the art. The invention is intended to encompass a reasonable range of embodiments that are equivalent to those disclosed as examples. Accordingly, reference should be made to the appended claims rather than the foregoing examples, to assess the scope of exclusive rights in the invention claimed.

What is claimed is:

1. A nozzle with micro orifices suitable for delivery of a liquid chemical agent comprising:

a plug with a conical surface;

a casing with a conical mating seat shaped so as to mate with the conical surface of the plug;

means for retaining the plug within the casing;

means forming a plurality of micro orifices comprising slots between the face of the conical surface of the plug and the mating seat, the orifices being from 0.001 to 0.015 inches (25 to 400 microns) at their maximum span, whereby the nozzle dispenses small, uniform droplets of emulsion.

2. The nozzle in claim 1 further comprising a means for filtering the emulsion to be dispensed, disposed upstream of the orifices in a flow direction.

3. The nozzle in claim 2, wherein the means for filtering the emulsion is retained within the casing.

4. The nozzle in claim 3, wherein the means for filtering the emulsion is a screen with suitable sized openings such that particles large enough to become lodged downstream in said flow direction in said plurality of capillary sized orifices will be blocked.

5. The nozzle in claim 4, wherein the means for retaining the plug is a plurality of first threads attached to the plug at a space away from the conical seat, the first threads being received in a plurality of second threads attached to the casing.

6. The nozzle in claim 4, wherein the means for retaining the plug is a flexible support such that the plug is movable momentarily away from the seat allowing any debris clogging said capillary orifices to be blown free by the pressure of the emulsion being dispensed.

7. The nozzle in claim 4 further comprising an enclosed bore suitable for receiving a tool, the bore being coaxial to the conical surfaces of the plug and the mating seat.

8. The nozzle in claim 1 wherein the means of forming a plurality of micro-orifices is a plurality of grooves applied to the face of the conical surface on the plug.

9. The nozzle in claim 8 wherein the cross sectional profile of the grooves has one of a rectangular, triangular and circular two dimensional geometric shape.

10. The nozzle in claim 1 wherein the means of forming a plurality of capillary sized openings is a plurality of grooves applied to the conical mating seat in the casing.

11. The nozzle in claim 10 wherein the cross sectional profile of the grooves has one of a rectangular, triangular and circular two dimensional geometric shape.

12. A nozzle with micro orifices suitable for delivery of a liquid chemical agent comprising:

a plug with a conical surface;

a casing with a conical mating seat shaped so as to mate with the conical surface of the plug;

means for retaining the plug within the casing;

means forming a plurality of micro orifices comprising slots between the face of the conical surface of the plug and the mating seats, the orifices being from 0.001 to 0.015 inches (25 to 400 microns) at their maximum span, said means forming a plurality of micro-orifices comprising a plurality of first grooves applied to the face of the conical surface of the plug and a plurality of second grooves applied to the conical mating seat in the casing.

13. The nozzle in claim 12 wherein the cross sectional profile of the grooves has one of a rectangular, triangular and circular two dimensional geometric shape.

14. The nozzle in claim 12 wherein the grooves are spaced and the plug and the mating seat are relatively rotatable for altering the alignment of the grooves on the plug with respect to the grooves on the mating seat, thereby altering the geometry of the plurality of capillary sized orifices and the size of the droplets of emulsion dispensed through said orifices.

15. A nozzle with micro orifices suitable for delivery of a liquid chemical agent comprising:

a plug with a conical surface;

a casing with a conical mating seat shaped so as to mate with the conical surface of the plug;

means for retaining the plug within the casing;

means forming a plurality of micro orifices comprising slots between the face of the conical surface of the plug and the mating seat, the orifices being from 0.004 to 0.007 inches (100 to 170 microns) at their maximum span, whereby the nozzle dispenses small, uniform droplets of emulsion.

* * * * *